US006592691B2

(12) United States Patent
Taylor et al.

(10) Patent No.: US 6,592,691 B2
(45) **Date of Patent: *Jul. 15, 2003**

(54) GAS GENERANT COMPOSITIONS CONTAINING COPPER ETHYLENEDIAMINE DINITRATE

(75) Inventors: Robert D. Taylor, Hyrum, UT (US); Ivan V. Mendenhall, Providence, UT (US); David W. Parkinson, North Ogden, UT (US)

(73) Assignee: Autoliv ASP, Inc., Ogden, UT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/544,915

(22) Filed: Apr. 7, 2000

(65) Prior Publication Data

US 2002/0148542 A1 Oct. 17, 2002

Related U.S. Application Data

(63) Continuation-in-part of application No. 09/306,304, filed on May 6, 1999, now Pat. No. 6,143,102.

(51) Int. Cl.[7] ..... C06B 31/00
(52) U.S. Cl. ..... 149/45; 149/46

(58) Field of Search ..... 149/45, 46

(56) References Cited

U.S. PATENT DOCUMENTS

| | | | | | |
|---|---|---|---|---|---|
| 5,197,758 | A | * | 3/1993 | Lund et al. | 149/61 |
| 5,531,941 | A | * | 7/1996 | Poole | 149/47 |
| 5,545,272 | A | * | 8/1996 | Poole et al. | 149/48 |
| 5,589,661 | A | * | 12/1996 | Menke et al. | 149/19.4 |
| 5,592,812 | A | * | 1/1997 | Hinshaw et al. | 149/45 |
| 5,608,183 | A | * | 3/1997 | Barner et al. | 149/45 |
| 5,635,668 | A | | 6/1997 | Barnes et al. | |
| 5,659,150 | A | * | 8/1997 | Butt et al. | 149/45 |
| 5,663,524 | A | * | 9/1997 | Bucerius et al. | 149/45 |
| 5,756,929 | A | * | 5/1998 | Lundstrom et al. | 149/45 |
| 5,779,267 | A | * | 7/1998 | Jordan et al. | 280/741 |
| 5,827,996 | A | * | 10/1998 | Yoshida et al. | 149/45 |
| 6,039,820 | A | * | 3/2000 | Hinshaw et al. | 149/45 |
| 6,074,502 | A | * | 6/2000 | Burns et al. | 149/46 |
| 6,103,030 | A | * | 8/2000 | Taylor et al. | 149/46 |
| 6,132,538 | A | * | 10/2000 | Mendenhall et al. | 149/46 |
| 6,143,102 | A | * | 11/2000 | Mendenhall et al. | 149/45 |

* cited by examiner

*Primary Examiner*—Edward A. Miller
(74) *Attorney, Agent, or Firm*—Sally J. Brown; James D. Erickson

(57) ABSTRACT

Gas generant compositions and methods of gas generation are provided whereby desired gas generation can be realized without requiring the presence and use a charge or coating of an associated igniter composition.

5 Claims, 1 Drawing Sheet

GAS GENERANT COMPOSITIONS CONTAINING COPPER ETHYLENEDIAMINE DINITRATE

CROSS REFERENCE TO RELATED APPLICATION

This application is a continuation-in-part of application Ser. No. 09/306,304, filed on May 6, 1999, now U.S. Pat. No. 6,143,102, issued Nov. 7, 2000.

BACKGROUND OF THE INVENTION

This invention relates generally to the generation of gas such as used in the inflation of automotive safety restraint airbag cushions and, more particularly, to gas generant compositions containing copper ethylenediamine dinitrate and associated methods of gas generation.

It is well known to protect a vehicle occupant using a cushion or bag, e.g., an "airbag cushion," that is inflated or expanded with gas such as when the vehicle encounters a sudden deceleration, such as in the event of a collision. In such systems, the airbag cushion is normally housed in an uninflated and folded condition to minimize space requirements. Upon actuation of the system, the cushion begins to be inflated in a matter of no more than a few milliseconds with gas produced or supplied by a device commonly referred to as an "inflator."

Many types of inflator devices have been disclosed in the art for use in the inflating of one or more inflatable restraint system airbag cushions. Many prior art inflator devices include a gas generant material having a solid form and which is burned to produce or form gas used in the inflation of an associated airbag cushion.

Gas generant compositions commonly utilized in the inflation of automotive inflatable restraint airbag cushions have previously most typically employed or been based on sodium azide. Such sodium azide-based compositions, upon initiation, normally produce or form nitrogen gas. While the use of sodium azide and certain other azide-based gas generant materials meets current industry specifications, guidelines and standards, such use may involve or raise potential concerns such as involving the safe and effective handling, supply and disposal of such gas generant materials.

Further, such inflator devices tend to involve ignition assemblies and processes which are either or both more complex and costly than desired. For example, airbag inflator ignition systems commonly involve first the ignition of an electrically ignited squib, which in turn ignites a supplemental secondary ignition charge, which finally ignites a quantity of a gas generant composition contained therewithin. Since the secondary igniter charge usually involves the use of expensive energetic ingredients (i.e., boron) and may impose expensive processing restraints or limitations (such as production of limited quantities due to safety constraints and containerization), there is a need for simple and effective alternatives to such ignition systems.

A common alternative means of obtaining substantially simultaneous ignition of an extended length of igniter composition charge is through the incorporation of an ignition cord within an inflator. In practice, it is common that such length of ignition cord be housed or contained within an igniter tube extending within the igniter charge. While ignition of an associated gas generant material may ultimately be achieved through the incorporation and use of such an ignition cord, such an ignition process may also be undesirably complicated and may also tend to undesirably complicate the manufacture, production and design of the inflator device. For example, such use necessitates that an igniter composition be manufactured or made and then subsequently handled such as through manufacture of a desired form of container to hold or store the igniter composition for subsequent incorporation into the inflator device design as a part of an igniter assembly.

In addition, the use of such an ignition process can detrimentally impact either or both the weight and cost of the corresponding apparatus hardware. For example, the incorporation and use of such an igniter tube and ignition cord typically will undesirably increase both the weight and cost associated with a corresponding assembly.

As will be appreciated, space is often at a premium in modem vehicle designs. Consequently, it is generally desired that the space requirements for various vehicular components, including inflatable vehicle occupant restraint systems, be reduced or minimized to as great an extent as possible. The incorporation of an igniter assembly such as described above and associated support structures, may require a larger than desired volume of space within an associated inflator device. In particular, such volume of space could alternatively potentially be utilized to store or contain gas generant material and thereby permit the volume of space required by the inflator device to be reduced.

Thus, there is a need and a demand for alternative airbag inflator device ignition schemes and, in particular, there is a need and a demand for avoiding the requirement or inclusion of separate igniter composition charges and associated hardware.

At least partially in response to the need for alternatives to inclusion of such ignition systems, substantial efforts have been directed to the formation of ignition enhanced gas generant materials such as involving coating of a gas generant material with an igniter material. While the practice of applying an igniter material as a thin coating directly on gas generant grains is a generally viable approach that has been used in the past, such an approach is subject to certain disadvantages. For example, such a coating process can be subject to variations in coating thickness and effectiveness such as to hinder or prevent attaining desired consistency and uniformity in performance. Further, the costs associated with such processing can detrimentally impact system economics.

In view of the above, there is a need and a demand for gas generant compositions suitable for use in inflate restraint system applications and which compositions are desirably easily ignitable without the use of any secondary igniter or applied igniter coating and which compositions desirably provide relatively high gas yields (e.g., gas outputs of about 3.00 moles or more of gas per hundred grams of composition).

SUMMARY OF THE INVENTION

A general object of the invention is to provide improved gas generation and, more particularly, to provide improved gas generant compositions and associated method of gas generation.

A more specific objective of the invention is to overcome one or more of the problems described above.

The general object of the invention can be attained, at least in part, through a gas generant composition which includes between about 1 and about 18 weight percent of copper II bis ethylenediamine dinitrate, between about 5 and about 50 weight percent of a gas generant co-fuel, and between about 40 and about 75 weight percent of a gas generant oxidizer component.

A gas generant composition in accordance with one preferred embodiment of the invention additionally contains or includes up to about 10 weight percent of a gas generant additive such as a bum rate enhancing and slag formation additive such as includes at least one member selected from the group consisting of silicon dioxide, aluminum oxide, titanium dioxide, zirconium oxide, zinc oxide, alkali metal salts and alkaline earth metal salts, for example.

The prior art generally fails to provide a gas generant composition of desired ignitability, such as may be used within an airbag inflator without necessitating the incorporation or use of an igniter composition, either as a separate and distinct charge or as a coating such as applied to an associated gas generant material.

The invention further comprehends a gas generant composition which contains or includes between about 5 and about 12 weight percent of copper II bis ethylenediamine dinitrate; between about 5 and about 50 weight percent of a gas generant co-fuel; and between about 40 and about 75 weight percent of a gas generant oxidizer component, wherein the gas generant oxidizer component comprises at least about 15 weight percent of copper diammine dinitrate.

The invention still further comprehends a method of gas generation which, in accordance with one preferred embodiment of the invention involves the step of igniting a composition containing between about 1 and about 18 weight percent of copper II bis ethylenediamine dinitrate; between about 5 and about 50 weight percent of a co-fuel; and between about 40 and about 75 weight percent of an oxidizer component to form reaction products which at least in part are in gaseous form.

As used herein, references to a material, component, compound or the like as a "fuel" are to be understood to refer to such material, component or compound as internally containing insufficient oxygen to allow it to fully combust to water, carbon dioxide, nitrogen and/or a corresponding metal oxide or metal without an added oxidizer or oxygen source.

Further, references herein to a material, component, compound or the like as an "oxidizer" are to be understood to refer to such material, component or compound as internally containing oxygen in a relative amount in excess of that required to allow it to fully combust to water, carbon dioxide, and/or a corresponding metal oxide.

References to a material, composition or formulation as a "gas generant" are to be understood to refer to those materials, compositions or formulations which upon combustion generally provide or result in a gas yield or output of at least about 2 moles of gas per 100 grams of material and, preferably, at least about 2.5 moles of gas per 100 grams of material and, more preferably, at least about 3 moles of gas per 100 grams of material. In practice, gas generant materials generally burn at a flame temperature of less than about 2500 K.

References to a material, composition or formulation as an "igniter" are to be understood to refer to those materials, compositions or formulations which upon combustion generally provide or result in a gas yield or output of less than about 1.5 moles of gas per 100 grams of material. In practice, igniter materials generally burn at a flame temperature of greater than about 3000 K.

Other objects and advantages will be apparent to those skilled in the art from the following detailed description taken in conjunction with the appended claims and drawings.

DETAILED DESCRIPTION OF THE INVENTION

Figure 1:
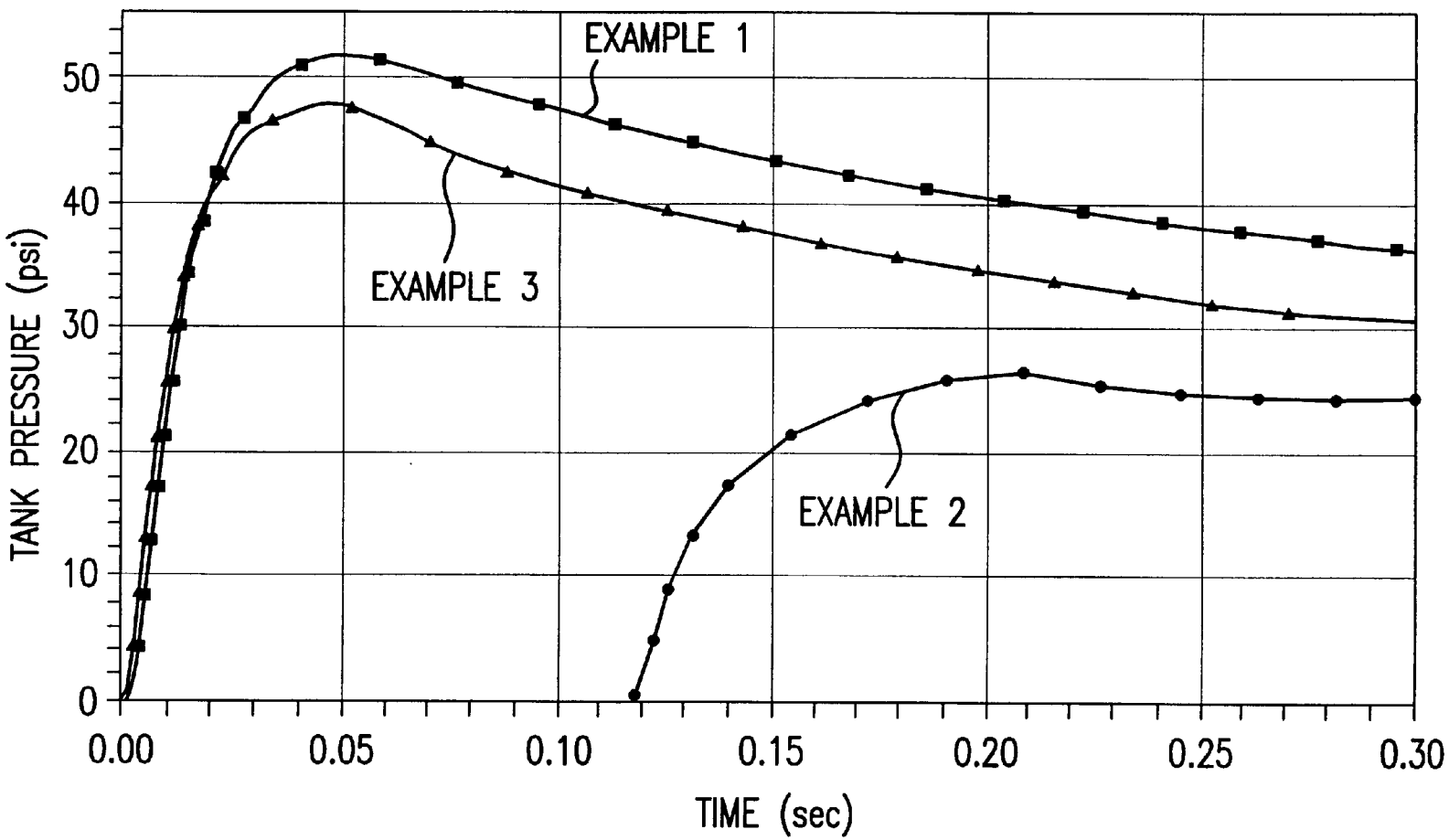
FIG. 1 shows the tank pressures as a function of time performances realized for the gas generant formulations of Examples 1–3.

The present invention provides improved gas generation and, more particularly, provides improved gas generant compositions and associated methods of gas generation such as may be used in the inflation of inflatable devices such as vehicle occupant restraint airbag cushions. Gas generant compositions in accordance with the invention desirably contain or include a fuel or combination of fuels, an oxidizer or combination of oxidizers and, if desired, additives such that the compositions are easily ignitable (e.g., may be used in an airbag inflator without a secondary igniter composition or the application thereto of a coating of igniter material). As detailed below, the gas generant compositions of the invention and the use thereof represent an advancement in the art as such compositions and the use thereof simplify the design of inflator devices by eliminating the need and use of either or both a secondary igniter component or an ignition coating applied to an associated gas generant material.

In accordance with a preferred embodiment of the invention, a gas generant composition preferably includes or contains between about 1 and about 18 weight percent of copper II bis ethylenediamine dinitrate, between about 5 and about 50 weight percent of a gas generant co-fuel, and between about 40 and about 75 weight percent of a gas generant oxidizer component.

In particular, the compositions of the invention desirably contain or include a fuel component such as in the form of a copper dinitrate complex of the form $Cu(L)_2(NO_3)_2$, where L equals ethylenediamine, used alone or in conjunction with other co-fuel components with an associated oxidizer and, if desired, optional additives. The increased ease of ignitability characteristics of the subject gas generant compositions is believed to be largely attributable to the proper inclusion of such copper dinitrate complex therein.

Gas generant compositions, in accordance with certain preferred embodiments of the invention, desirably include or contain such copper nitrate complex in at least a minimum level constituting about 1 weight percent of the gas generant composition in order to achieve or attain at least some of the advantages of the invention such as relating to improved ignitability. Further, gas generant compositions in accordance with certain preferred embodiments of the invention, desirably include or contain such copper nitrate complex in level or relative amount no more than about 18 weight percent of the gas generant composition in order to avoid significantly detrimentally impacting the gas yield resulting from combustion of such compositions.

In accordance with certain particularly preferred embodiments of the invention, gas generant compositions desirably include or contain between about 5 and about 12 weight percent, preferably between about 8 and about 10 weight percent of copper II bis ethylenediamine dinitrate as such inclusion has been found to desirably result or produce a gas generant composition which provides a preferred balance of improved ignitability and sufficient gas yield for various applications such as in the inflation of automotive restraint devices.

In addition to the above-specified copper dinitrate complexes, the gas generant compositions of the invention may also contain co-fuels such as may be included or used such as to adjust one or more of the following performance of processing characteristics or parameters of such gas generant compositions, e.g., the gas output, adiabatic flame temperature, burning rate, and processability. The designation of such component as a "co-fuel" is simply used to identify that the inclusion of such fuel component is in addition to the copper dinitrate complex, identified above, without necessary limitation as to which is present in a greater or lesser relative amount.

In accordance with the broader practice of the invention, various gas generant co-fuels can be used. In particular, suitable gas generant co-fuels in accordance with specific embodiments of the invention include: guanidine nitrate, nitroguanidine, aminoguanidine nitrate, diaminoguanidine nitrate, triaminoguanidine nitrate, aminotetrazole, aminotetrazole salts and complexes, bitetrazole, bitetrazole salts and complexes, triazoles, triazole salts and complexes, tetrazoles, tetrazoles salts and complexes, dicyandiamide, cyanamide, cyanamide salts and complexes, nitrotiazalone, nitrotriazalone salts and complexes, and azodicarbonamide, for example. In addition, those skilled in the art and guided by the teachings herein provided will appreciate that the broader practice of the invention also encompasses the use of other gas generant co-fuels in combination with the above-specified copper dinitrate complexes.

Compositions in accordance with the invention desirably also contain or include an oxidizer component. As will be appreciated by one skilled in the art and guided by the teachings herein provided, various oxidizer components can desirably be utilized in the gas generant compositions of the invention. As detailed below, however, a preferred oxidizer material for use in the invention desirably contains or includes copper diammine dinitrate (CDDN), either alone or in combination with at least ammonium nitrate.

In one particular preferred embodiment of the invention, when used with ammonium nitrate, at least about 15 percent of the total oxidizer content is copper diammine dinitrate such as may be desired or required to ensure desired phase stabilization of the ammonium nitrate. Thus, a preferred oxidizer material for use in the invention desirably contains or includes at least about 15 weight percent (based on oxidizer component weight) copper diammine dinitrate.

The gas generant compositions of the invention may also desirably include or contain a small amount, e.g., typically up to about 10 composition weight percent, of one or more gas generant composition additives. Suitable gas generant additives may, dependent on the specific application or use, may include one or more bum rate enhancing and slag formation additive or processing aid additive. For example, suitable bum rate enhancing and slag formation additives may, dependent on the specific application, include silicon dioxide, aluminum oxide, titanium dioxide, zirconium oxide, zinc oxide, alkali metal salts, alkaline earth metal salts and various combinations thereof.

Alternatively or in addition, gas generant compositions in accordance with the invention may desirably contain or include an additive such as in the form of a processing aid additive. As will be appreciated by those skilled in the art and guided by the teachings herein provided, the inclusion or practice of the invention with one or more of such processing aids may be variously desired such as dependent on the specific application. For example, processing aid additives such as calcium stearate, mica, molybdenum disulfide, graphite, and combinations thereof may be included as mold release aids such as to facilitate machine pressing of the subject compositions into tablets, wafers or other desired grain geometries. It will be appreciated that other processing additives, such as know in the art may also be used in the practice of the invention by those skilled in the art and guided by the teachings herein provided.

Gas generant compositions in accordance with the invention can be appropriately prepared using various suitable preparation techniques. For example, in accordance with one preparation technique, the copper II bis ethylenediamine dinitrate complex is formed "in-situ" in an aqueous slurry by dissolving cupric nitrate in water followed by addition of ethylenediamine (two moles per mole copper nitrate) liquid to the solution. The changing of the color of the solution from blue to purple evidences complex formation. The complex is immediately formed and is very water-soluble. Other gas generant composition ingredients or suitable component precursors (such as co-fuel, oxidizer, copper oxide, and additives, for example) can then be added to the solution to form an aqueous slurry. The slurry is subsequently spray dried and then heat treated such as to form the copper diammine dinitrate. After heat treating the powder is pressed into a desired form such as in the form of a tablet, wafer or grain.

Alternatively, gas generant compositions in accordance with the invention can be appropriately prepared by an alternative technique wherein enough cupric nitrate is dissolved in water to form the required amount of copper II bis ethylenediamine dinitrate and copper diammine dinitrate. In accordance with such preparation technique, ethylenediamine is first added and the requisite amount of copper II bis ethylenediamine dinitrate is immediately formed. An ammonia source (such as ammonium carbonate, ammonium bicarbonate, ammonium hydroxide, or anhydrous ammonia, for example) is added to the solution and reacts with the excess cupric nitrate to form copper diammine dinitrate. Other gas generant composition ingredients (such as co-fuel and additives, for example) are added to the aqueous slurry. The slurry is subsequently spray dried and pressed into a desired form such as in the form of a table, wafer or grain.

In view of the above, it is to be understood that the broader practice of the invention is not necessarily limited to a specific or particular preparation technique.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Examples 1–3

In Example 1, a gas generant composition in accordance with one embodiment of the invention and composed as shown in TABLE 1 below was prepared employing the "in-situ" preparation technique described above.

Examples 2 and 3 are comparative examples wherein a gas generant composition as also shown in TABLE 1 below was similarly prepared.

TABLE 1

| COMPONENT | Example 1 | Examples 2 and 3 |
|---|---|---|
| Copper II bis ethylenediamine dinitrate | 8.00 | — |
| Guanidine Nitrate | 30.61 | 42.95 |
| CDDN | 56.29 | 51.95 |
| $SiO_2$ | 5.10 | 5.10 |

For each of these examples, the respective gas generant compositions were pressed into 0.25 inch diameter, 0.080 inch thick tablets on a rotary pharmaceutical type tablet press. Then a 32-gram sample of each of the respective gas generant formulations was loaded into a cylindrical perforated metal basket. In Example 3, an igniter formulation containing 68.58 weight percent strontium nitrate and 31.42 weight percent of an Al/Mg alloy (composed of 70 percent Al and 30 percent Mg) was sprayed-directly onto the top layers of tablets in the basket to form a 2.5 weight percent igniter coating thereon, where the igniter coating weight percent is based on the combined weights of the gas generant and igniter materials.

In each case, the loaded basket was placed into a steel cylindrical inflator simulator equipped with a squib (electronic match) at one end used to ignite the gas generant and one or more nozzles at the other end used to adjust and control the combustion pressure. The inflator simulator was mated to a 60-liter steel tank equipped with a pressure measuring port and a gas sampling port. The squib was ignited remotely by means of an electric current. Tank pressure vs. time performance was recorded by means of a pressure transducer and data collection system. The time to first pressure in the tank was employed as a measure of ignitability.

Discussion of Results

FIG. 1 shows the tank pressure as a function of time performances realized for the gas generant formulations of Examples 1–3.

Employing the commonly applied definition of "ignitability" in terms of the time till pressure is first observed (i.e., measurable) in a tank into which the particular device is fired, FIG. 1 shows that the gas generant composition of comparative Example 2 experienced significant lag time between firing and the first measurable pressure within the associated test tank. FIG. 1 shows that the gas generant compositions of Example 1 and of comparative Example 3 (which composition included or had applied an igniter coating thereto) exhibited comparable ignitabilities. It will be appreciated, however, that the composition of the invention (e.g., Example 1) avoids various of the complications and difficulties relating to igniter coatings and the application thereof, detailed above.

Further, the gas generant composition of Example 1 was found to provide a gas output in the range of about 3.0–3.3 moles of gas/100 grams of gas generant composition and suitable for typical vehicle inflatable restraint installations. Though such gas output was slightly less than the 3.5 moles of gas/100 grams of gas generant composition realized with the gas generant composition of comparative Example 2, such reduction in gas output may at least in part be compensated through the subject gas generant materials desirably being of relatively increased density and thus at least providing comparable gas yields per unit weight volume of gas generant.

Examples 4–11

In Examples 4–10, gas generant compositions in accordance with the invention and composed as shown in TABLES 2 and 3 below were prepared employing the alternative preparation technique described above. In accordance with such technique, enough cupric nitrate was dissolved in water to form the required amount of copper II bis ethylenediamine dinitrate and copper diammine dinitrate. In particular, ethylenediamine was first added and the requisite amount of copper II bis ethylenediamine dinitrate was immediately formed. An ammonia source (such as ammonium carbonate, ammonium bicarbonate, ammonium hydroxide, or anhydrous ammonia, for example) was added to the solution and reacted with the excess cupric nitrate to form copper diammine dinitrate. Other gas generant composition ingredients (such as co-fuel and additives, for example) were then added to the aqueous slurry. The slurry was then subsequently vacuum over dried. These gas generant compositions were then respectively pressed into the shape of cylinders (0.5 inch in diameter). The length of the cylinder was measured and recorded.

TABLE 2

| | COMPOSITION | | | |
|---|---|---|---|---|
| EXAMPLE | Copper II bis ethylenediamine dinitrate | CO-FUEL | CDDN | $SiO_2$ |
| 4 | 8.00 | 30.61 | 56.29 | 5.10 |
| 5 | 8.00 | 28.81 | 58.09 | 5.10 |
| 6 | 8.00 | 33.13 | 53.77 | 5.10 |
| 7 | 8.00 | 27.90 | 59.00 | 5.10 |
| 8 | 8.00 | 16.76 | 70.14 | 5.10 |
| 9 | 8.00 | 23.20 | 63.70 | 5.10 |
| 10 | 8.00 | 19.30 | 67.60 | 5.10 |

TABLE 3

| EXAMPLE | CO-FUEL |
|---|---|
| 4 | guanidine nitrate |
| 5 | aminoguanidine nitrate |
| 6 | nitrotriazalone |
| 7 | nitroguanidine |
| 8 | 5-amino tetrazole |
| 9 | copper II aminotetrazole |
| 10 | diammonium bitetrazole |

Example 11 is a comparative example wherein the gas generant composition of Examples 2 and 3, described above, was similarly respectively pressed into the shape of a cylinder (0.5 inch in diameter), with the length of the cylinder measured and recorded.

The cylinders formed of the gas generant compositions of each of Examples 4–11 was then tested employing the following testing regime:

One end of each of the cylinder was covered with a piece of masking tape and the other surfaces of the cylinder were coated with a polymer that inhibits ignition. The cylinder was then placed upright in a one-liter stainless steel vessel. A nichrome wire was placed across the top of the cylinder in contact with the uncoated end and connected to two electrodes. A small charge of igniter powder was placed over the nichrome wire to accelerate ignition of the cylinder. The test tank was sealed and pressurized to 900 psi with an inert gas (e.g., nitrogen). Current was passed through the electrodes and the cylinder ignited. The gas generant burnt in a linear fashion and produced gas to increase the pressure in the test tank. The tank pressure was read and recorded at millisecond intervals. A plot of pressure vs. time showed the start and the end of the gas generant burn. The length of the cylinder divided by the time required for burning provided a measurement of the bum rate. This experiment is repeated at 1350, 2000, and 3000 psi and a plot of the log burn rate vs. log average pressure resulted in a straight line with slope=n and y intercept=b. Estimation of the two parameters allowed calculation of the burn rate at any pressure through the following equation:

$$\text{Burn rate(inches/sec)}=P^nC$$

where,

P=pressure in psi

N=slope

C=constant=$10^b$ b=y intercept

The results of such testing are provided in TABLE 4, below.

TABLE 4

| EXAMPLE | Burn Rate | Burn Rate Slope | Burn Rate Constant |
|---|---|---|---|
| 4 | 0.36 | 0.54 | 0.009 |
| 5 | 0.43 | 0.59 | 0.007 |
| 6 | 0.89 | 0.68 | 0.008 |
| 7 | 0.38 | 0.69 | 0.003 |
| 8 | 0.97 | 0.47 | 0.039 |
| 9 | 1.02 | 0.39 | 0.068 |
| 10 | 0.46 | 0.60 | 0.007 |
| 11 | 0.46 | 0.56 | 0.008 |

Discussion of Results

The mass flow rate of gas from the surface of a burning gas generant material of a given geometry increases with increasing burn rate. Therefore, higher bum rates allow use of larger geometries and fewer total grains to achieve a given mass flow rate versus formulations with lower burn rates. Typically, a linear burn rate of greater than 0.3 inches per second is desirable for airbag applications. The slope of a log burn rate vs. log pressure curve is a measure of the sensitivity of the burn rate to pressure. Since it is generally desirable to achieve minimal performance variation over a range of operating conditions in airbag deployments, low slope values (typically<0.6) are generally desired.

The example data show that a range of burn rates and slopes can be obtained by gas generant compositions in accordance with the invention through the use of various co-fuels.

Thus, the invention provides gas generant compositions and methods of gas generation whereby desired gas generation can be realized without requiring the presence and use a charge or coating of an associated igniter composition. In particular, the invention provides gas generant compositions and methods of gas generation such that desirably provide or result in a gas yield or output of at least about 2 moles of gas per 100 grams of material and, preferably, gas outputs of at least about 2.5 moles or more of gas per 100 grams of material and, more preferably, gas outputs of about 3.0 moles or more of gas per 100 grams of material, while avoiding or not requiring the presence and use a charge or coating of an associated igniter composition in order to attain desired ignitability performance, such as required or desired for typical vehicle inflatable restraint systems.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A gas generant composition comprising:

between about 1 and about 18 weight percent of copper II bis ethylenediamine dinitrate;

between about 5 and about 50 weight percent of guanidine nitrate; and between about 40 and about 75 weight percent of a gas generant oxidizer component, wherein at least about 15 weight percent of the gas generant oxidizer component comprises copper diammine dinitrate.

2. The gas generant composition of claim 1 wherein the gas generant oxidizer component additionally comprises ammonium nitrate.

3. The gas generant composition of claim 1 wherein the gas generant oxidizer component consists essentially of copper diammine dinitrate.

4. The gas generant composition of claim 1 comprising about 5 to about 12 weight percent of copper II bis ethylenediamine dinitrate.

5. The gas generant composition of claim 4 comprising about 8 to about 10 weight percent of copper II bis ethylenediamine dinitrate.

* * * * *